US010018437B2

(12) United States Patent
Phipps et al.

(10) Patent No.: US 10,018,437 B2
(45) Date of Patent: Jul. 10, 2018

(54) FIREARM BOLT CATCH ASSEMBLY

(71) Applicants: Darin M. Phipps, Jacksonville, FL (US); Rick W. VanVliet, St. Augustine, FL (US)

(72) Inventors: Darin M. Phipps, Jacksonville, FL (US); Rick W. VanVliet, St. Augustine, FL (US)

( * ) Notice: Subject to any disclaimer, the term of this patent is extended or adjusted under 35 U.S.C. 154(b) by 0 days.

(21) Appl. No.: 15/383,746

(22) Filed: Dec. 19, 2016

(65) Prior Publication Data

US 2017/0299303 A1 Oct. 19, 2017

Related U.S. Application Data

(60) Provisional application No. 62/268,923, filed on Dec. 17, 2015.

(51) Int. Cl.
*F41A 19/64* (2006.01)
*F41A 17/36* (2006.01)
*F41A 3/66* (2006.01)

(52) U.S. Cl.
CPC ..... *F41A 17/36* (2013.01); *F41A 3/66* (2013.01)

(58) Field of Classification Search
CPC ..... F41A 17/36; F41A 3/66; F41A 3/68
USPC ..... 89/138
See application file for complete search history.

(56) References Cited

U.S. PATENT DOCUMENTS 2,571,132 A 10/1951 Harvey
3,540,142 A 11/1970 Vartanian et al.
4,057,003 A 11/1977 Atchisson
4,069,608 A 1/1978 Jurek
4,128,042 A 12/1978 Atchisson
6,510,778 B1 1/2003 Irwin
6,606,811 B1 8/2003 Olson
7,661,219 B1 2/2010 Knight, Jr. et al.
8,359,966 B1 1/2013 Brotherton
8,387,296 B2 3/2013 Overstreet et al.
8,479,635 B2 7/2013 Overstreet et al.
8,695,477 B2 4/2014 Esch
9,091,499 B2 7/2015 Overstreet et al.
9,194,637 B2 * 11/2015 Mather ..... F41A 17/38
2011/0247483 A1 * 10/2011 Overstreet ..... F41A 9/70 89/138

(Continued)

OTHER PUBLICATIONS

BLASTEROD1. New 9mm AR-15 Conversion. YouTube. Mar. 23, 2013[Retrieved Feb. 10, 2017]. Retrieved on he Internet: <URL:https://www.youtube.com/watch?v=JBJlz00ggYa>.

(Continued)

*Primary Examiner* — Samir Abdosh
(74) *Attorney, Agent, or Firm* — Thomas C. Saitta

(57) ABSTRACT

An improved firearm bolt catch assembly for the lower receiver of a firearm, the assembly having a lift arm that retains the bolt of the firearm in a retracted position after the cartridge magazine has been emptied, such that the firearm does not need to be re-racked when an empty magazine is removed and replaced with a full magazine. The lift arm is substantially C-shaped, having an elongated middle segment and a pair of transverse legs. Each of the transverse legs is pivotally mounted onto the lower receiver. The lift arm is raised by the magazine follower when the last cartridge has been discharged. An insert assembly is also disclosed.

20 Claims, 7 Drawing Sheets

(56) References Cited

U.S. PATENT DOCUMENTS

| | | | | |
|---|---|---|---|---|
| 2012/0167424 | A1* | 7/2012 | Gomez | F41A 17/42<br>42/14 |
| 2017/0160032 | A1* | 6/2017 | Overstreet | F41A 17/36 |
| 2017/0241729 | A1* | 8/2017 | Gangl | F41A 17/36 |

OTHER PUBLICATIONS

PCT International Search Report and Written Opinion—PCT/US2016/067584.

* cited by examiner

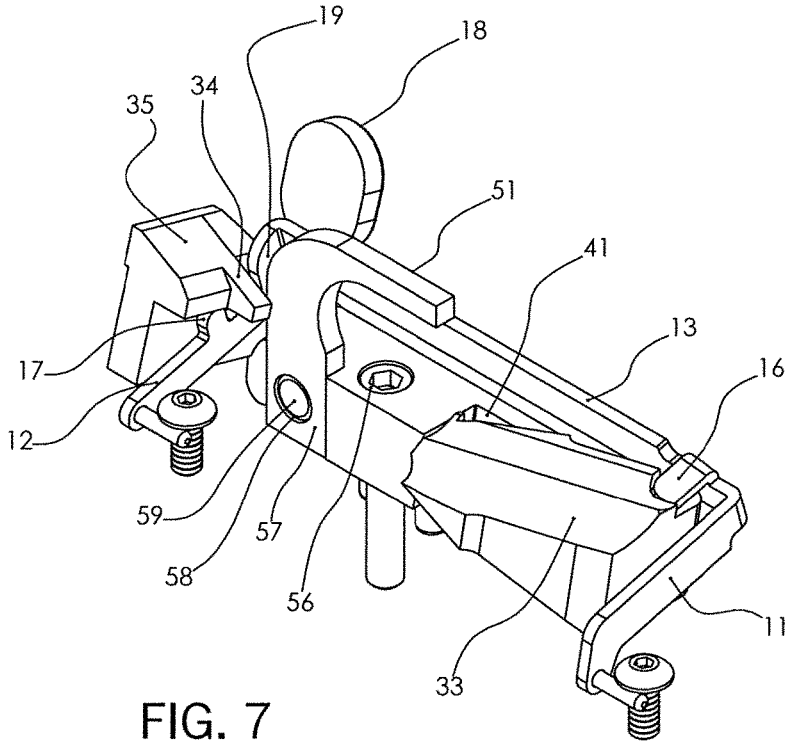
FIG. 7
FIG. 8
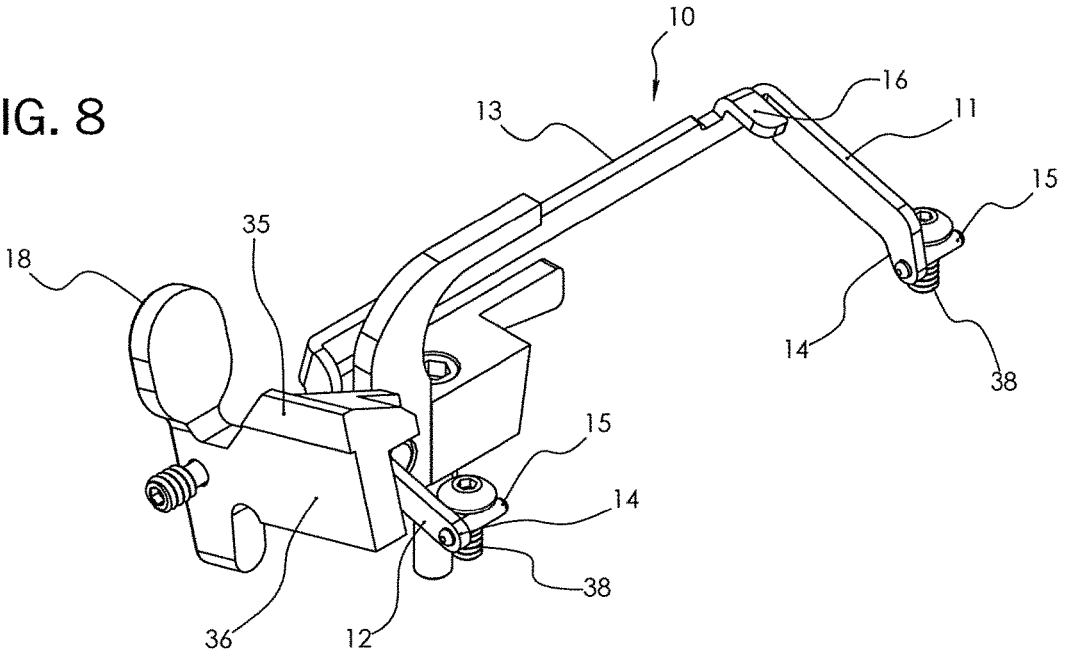

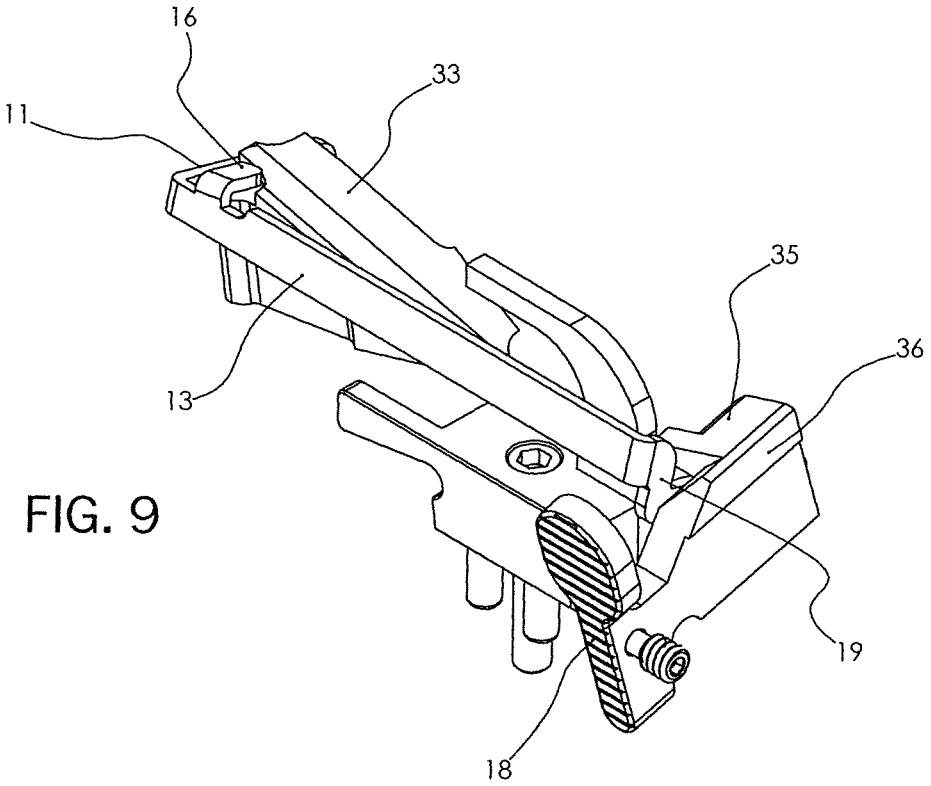
FIG. 9
FIG. 10
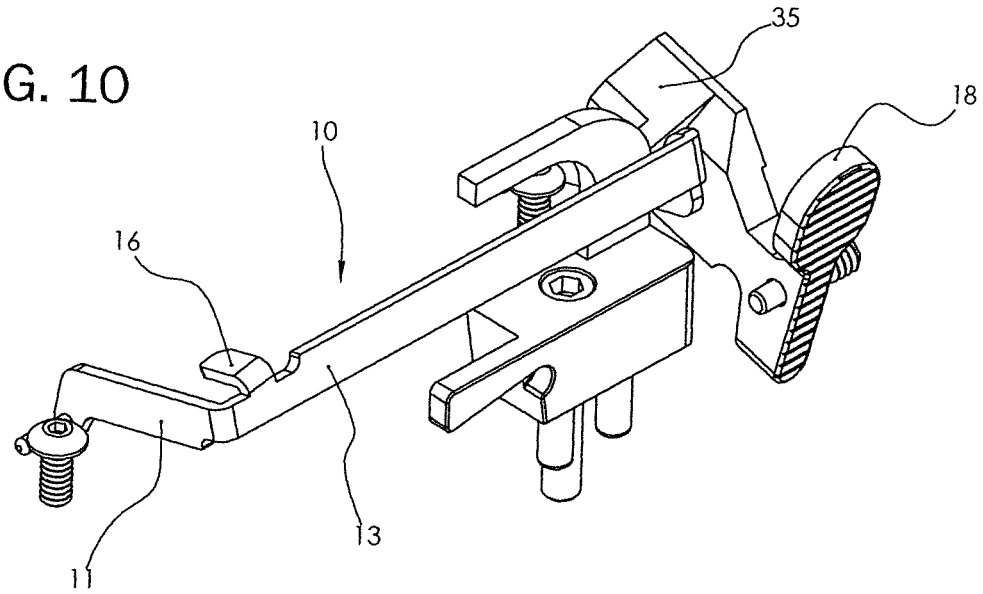

FIREARM BOLT CATCH ASSEMBLY

This application claims the benefit of U.S. Provisional Patent Application Ser. No. 62/268,923, filed Dec. 17, 2015.

BACKGROUND OF THE INVENTION

This application relates generally to the field of bolt catch assemblies, also referred to as bolt stop assemblies or bolt hold assemblies, incorporated into or combined with the lower receiver of semi-automatic firearms having multi-cartridge magazines to feed ammunition into the firearm. The bolt catch assembly holds the bolt in the open or recessed position when the magazine is empty, such that it is not necessary to re-rack the bolt when the empty magazine is exchanged for a full magazine.

To fire multiple rounds from a magazine-loaded firearm, the shooter firsts rack the bolt to load the first round from the magazine into the weapon. As successive rounds are fired, the magazine empties and a follower activates a bolt catch lifter, also called an activator arm or lift arm, to secure the bolt catch and prevent the bolt from advancing. When the empty magazine is replaced with a full magazine, firing may resume without the need to re-rack the bolt.

Bolt catch assemblies are well known. In a typical embodiment, the lift arm comprises an elongated linear segment pivotally mounted on its forward end to the lower receiver of the firearm. A follower flange or tab extends laterally over the magazine well of the lower receiver at a location where it is contacted by the magazine follower of an empty magazine, thereby elevating the free rearward end of the lift arm. The lift arm further comprises an L-shaped portion extending transversely across the body of the lower receiver, the L-shaped portion ending in an apertured structure that cooperates with an extension on the bolt catch, such that when the free end of the lift arm is pivoted upward, the bolt catch is raised and blocks the bolt from advancing. Upon replacement of the magazine, the bolt catch is manually released.

This known design for the lift arm utilizing a single pivot point results in a torqueing effect during operation, since the apertured structure on the end of the L-shaped portion that contacts the bolt catch is offset from the linear segment of the lift arm. This latch-style structure is flimsy and operates in a relatively loose manner since it is necessary to allow for some degree of play in the mechanism.

It is an object of this invention to provide a bolt catch assembly wherein the lift arm is structured as a C-shaped member, with each of the transverse legs of the lift arm being pivotally mounted to the lower receiver. It is a further object to provide a bolt catch assembly having an insert assembly for the cartridge ejector and magazine stop that does not require the use of lateral pins, the insert assembly being bolted from the top.

SUMMARY OF THE INVENTION

The invention comprises in general an improved firearm bolt catch assembly for the lower receiver of a firearm, the assembly having a lift arm that retains the bolt of the firearm in a retracted position after the cartridge magazine has been emptied, such that the firearm does not need to be re-racked when an empty magazine is removed and replaced with a full magazine. The lift arm is substantially C-shaped, having an elongated middle segment and a pair of transverse legs. Each of the transverse legs is pivotally mounted onto the lower receiver. The lift arm is raised by the magazine follower when the last cartridge has been discharged. An insert assembly is also disclosed.

Alternatively summarized, the invention is a firearm bolt catch assembly comprising a lift arm, said lift arm comprising a middle segment, a forward leg and a rearward leg, said forward leg having an end adapted to be pivotally mounted onto a lower receiver of a firearm and said rearward leg having an end adapted to be pivotally mounted onto a lower receiver of a firearm; and further wherein said lift arm is C-shaped; wherein said end of said forward leg is apertured and adapted to receive a first pin, and said end of said rearward leg is apertured and adapted to receive a second pin; wherein said end of said forward leg and said rearward leg are each joined to said middle segment at a right angle; wherein said rearward leg is joined to said middle segment by a transition segment such that said rearward leg is lower than said forward leg when pivotally mounted to the lower receiver of the firearm; said lift arm further comprising a follower contact member, whereby said lift arm is pivotally raised when a magazine follower contacts said follower contact member, and/or further comprising an insert assembly comprising a block body, a cartridge ejector and a magazine stop.

Alternatively, the invention is a firearm bolt catch assembly in combination with a firearm lower receiver, said assembly comprising a lift arm, said lift arm comprising a middle segment, a forward leg and a rearward leg, said forward leg having an end pivotally mounted onto said firearm lower receiver and said rear leg having an end pivotally mounted onto said firearm lower receiver; and further wherein said lift arm is C-shaped; wherein said end of said forward leg is apertured and adapted to receive a first pin, and said end of said rearward leg is apertured and adapted to receive a second pin; wherein said forward leg and said rearward leg are each joined to said middle segment at a right angle; wherein said rearward leg is joined to said middle segment by a transition segment such that said rearward leg is lower than said forward leg when pivotally mounted to the firearm lower receiver; said lift arm further comprising a follower contact member, whereby said lift arm is pivotally raised when a magazine follower of a magazine inserted into said lower receiver contacts said follower contact member; said firearm lower receiver comprises an upper surface and two transverse recesses disposed in said upper surface, and wherein said forward leg and said rearward leg are positioned at least partially in said transverse recesses; and/or said firearm lower receiver further comprising an insert recess, said combination further comprising an insert assembly inserted into said insert recess, said insert assembly comprising a block body, a cartridge ejector and a magazine stop.

BRIEF DESCRIPTION OF THE DRAWINGS

FIGS. 7 and 9 are perspective views of the bolt catch assembly and insert assembly, also showing the magazine follower and bolt catch FIGS. 8 and 10 are perspective views of the bolt catch assembly and insert assembly of FIGS. 5 and 6.

DETAILED DESCRIPTION OF THE INVENTION

Figure 1:
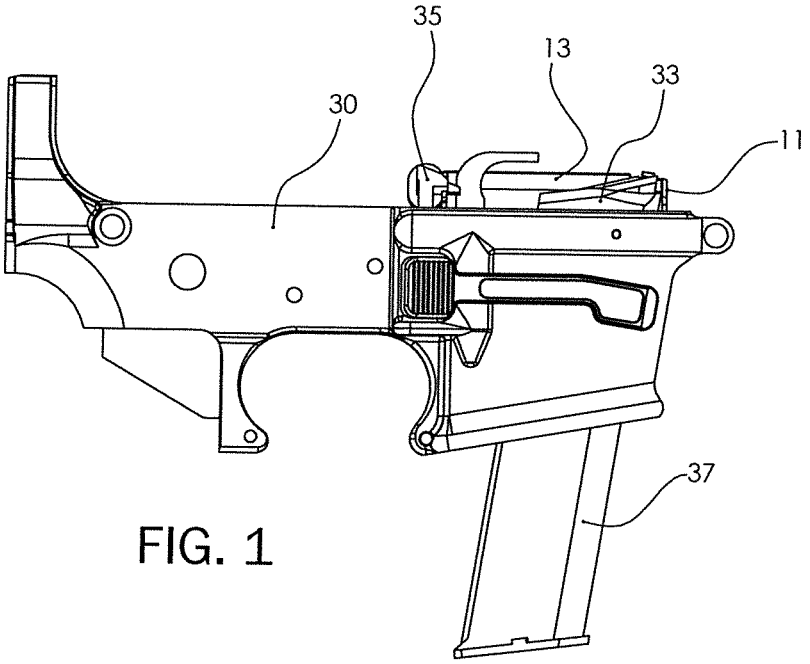
FIG. 1 is a plan view of a representative lower receiver with the bolt catch assembly.
Figure 2:
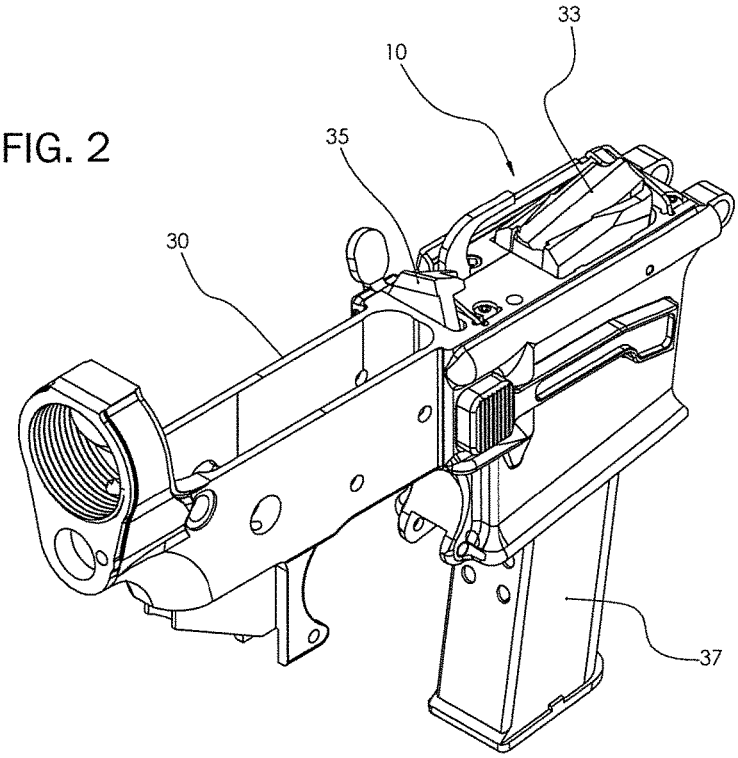
FIGS. 2 and 3 are perspective views of the embodiment of FIG. 1.
Figure 3:
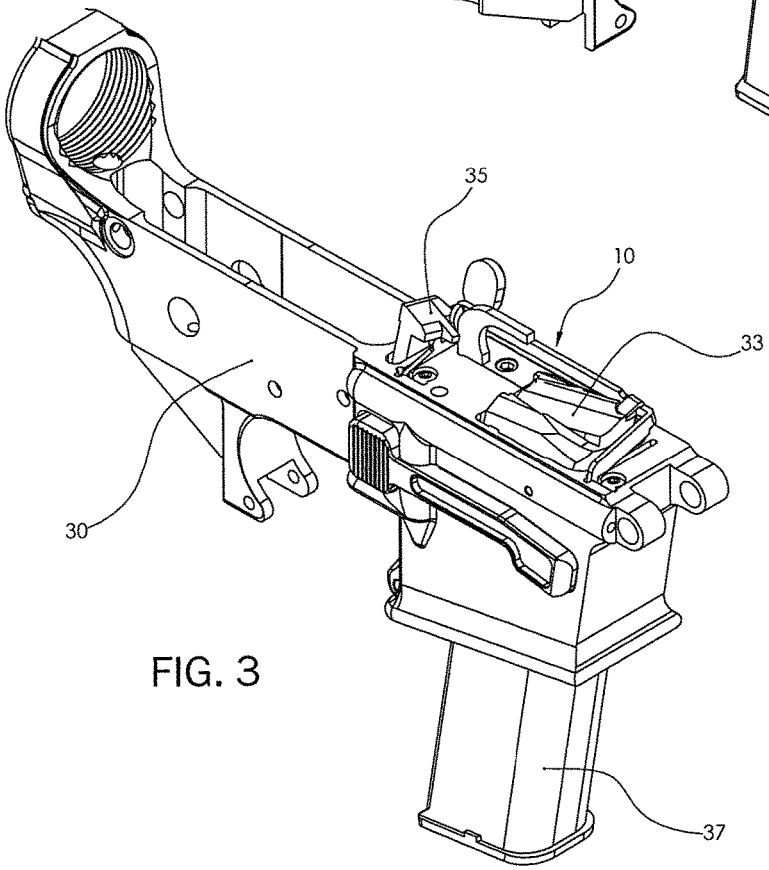
Figure 4:
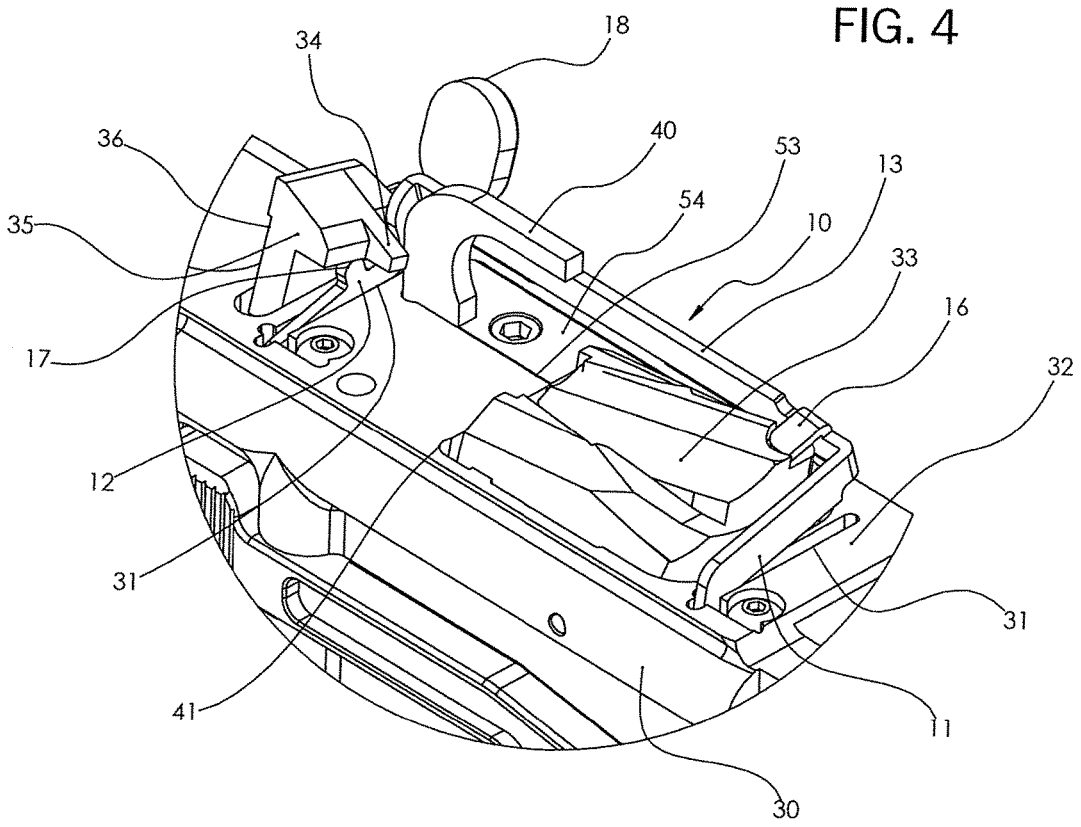
FIG. 4 is a detail view showing the bolt catch assembly in a lower receiver.
Figure 5:
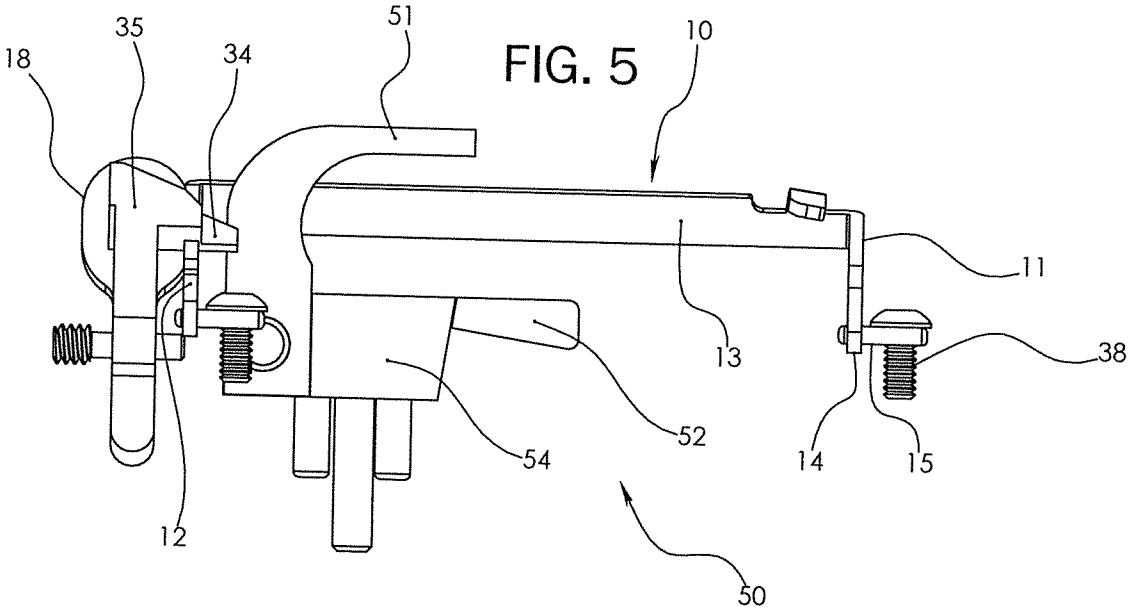
FIGS. 5 and 6 are plan views of the bolt catch assembly and insert assembly.
Figure 6:
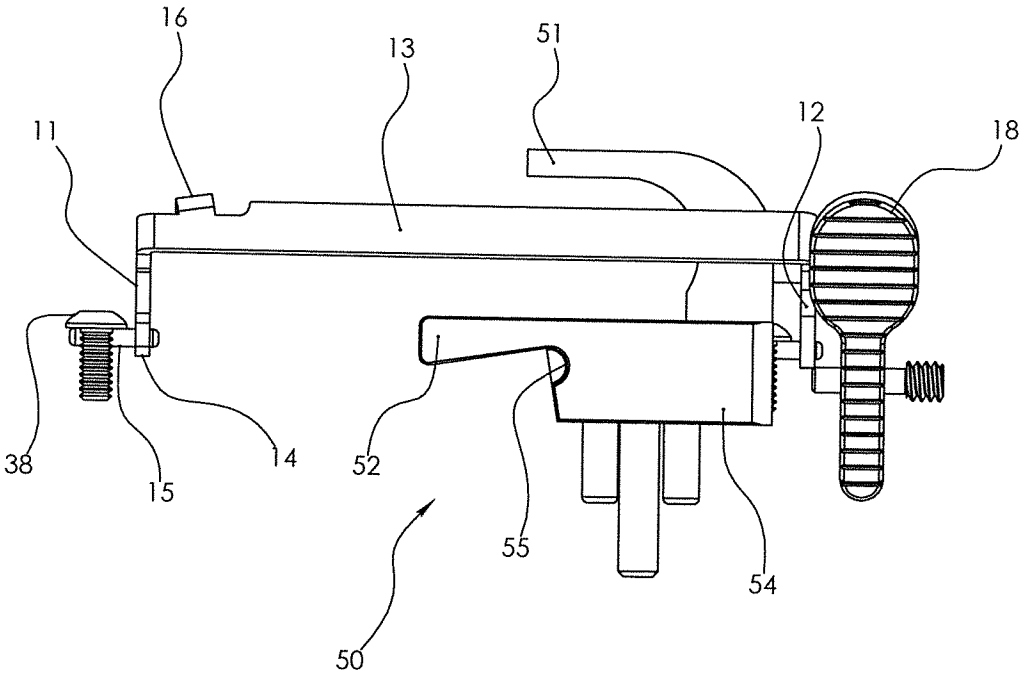

With reference to the drawings, the illustrations being presented as representative embodiments not intended to be limiting to the scope of the invention, the invention will now be described. As used herein, the term "forward" or related terms shall be taken to be the direction toward the barrel of the rifle, while "rearward" or related terms shall be taken to be the direction toward the stock of the rifle. The term "transverse" or related terms shall be taken to be the direction generally perpendicular or crossing the longitudinal axis of the firearm In general, the invention is a firearm bolt catch assembly, shown in one or more embodiments suitable for a Glock firearm, the bolt catch assembly comprising a double-pivot, C-shaped lift or actuator arm 10 pivotally mounted to a lower receiver 30, the lift aim 10 having two shorter segments or legs 11/12, a forward leg 11 and a rearward leg 12 each extending transversely across the lower receiver 30, and an elongated, generally linear, middle segment 13 extending longitudinally along the lower receiver 30. Each of the transverse legs 11/12 of the lift arm 30 is positioned partially or fully in a transverse slot or recess 31 cut into the upper surface 32 of the lower receiver 30. In this embodiment, the longitudinal middle segment 13 rests atop or slightly above the upper surface 32 of the lower receiver 30. Alternatively, a C-shaped recess 31 may be provided in the upper surface 32 of the lower receiver 30, the C-shaped recess 31 corresponding to the configuration of the lift arm 10 such that the transverse forward and rearward legs 11/12 and the middle segment 13 all rest partially or fully within the C-shaped recess 31. The end 14 of each of legs 11/12 is pivotally mounted to the lower receiver, most preferably in a recessed position. In the illustrated embodiment, the ends 14 are apertured to each receive a pin 15 disposed below the upper surface 32 of the lower receiver, the first and second pins 15 being held in place by mechanical fasteners 38, such as machine screws. Most preferably the pins 15 are aligned on the same axis. In this manner, the middle segment 13 may pivot upward away from the upper surface 32 of the lower receiver 30.

The lift arm 10 is provided with a follower contact member 16, such as tab, flange or post member, extending a short distance into the interior of the lift arm 10, the follower contact member 16 being disposed across the open upper end of the magazine well 41 and located in a position such that the upwardly advancing follower 33 of the magazine 37 will contact the follower contact member 16 when all of the rounds have been emptied from the magazine 37. The follower contact member 16 is most preferably located near the corner of the lift arm 10 defined by the forward leg 11 and the forward end of the middle segment 13. With this structure, advancement of the magazine follower 33 pivots the lift arm 10 upwardly away from the upper surface 32 of the lower receiver.

When the lift arm 10 is pivoted upward by the magazine follower 37, a portion of the rearward leg 12 contacts a forward extension structure 34 on the bolt catch 35, causing the bolt catch 35 to pivot upwardly such that its rear face 36 blocks the rifle bolt (not shown) from advancing forward. Preferably, the upper edge of the rearward leg 12 is provided with a raised projection 17, such as a protrusion, nub, hump or like structure, to more effectively raise the bolt catch 35. The pressure of the bolt against the rear face 36 of the bolt catch 35 maintains the bolt catch 35 in the blocking position when the empty magazine 37 is removed and replaced with a full magazine 37. Upon replacement, the shooter presses manually presses the externally mounted bolt catch release 18 to force the bolt catch 35 into the recessed position such that it no longer blocks forward movement of the bolt.

In a more preferred embodiment, the apertured end 14 of the forward leg 11 of the lift arm 10 is angled downward. The forward leg 11 and the middle segment 13 are preferably joined at a right angle, as are the rearward leg 12 and the middle segment 13. The rearward leg 12 is joined to the middle segment 13 by a transition segment 19 such that the majority of the rearward leg 12 is lower than the longitudinal middle segment 13 and the forward leg 11. Because the rearward leg 12 is lower than the front leg 11 and the middle segment 13, the rearward recess 31 is deeper than the forward recess 31 for the forward leg 11. The upwardly extending projection 17 is positioned on the rearward leg 12 just beyond the transition segment 19. The offset of the rear leg 12 provides clearance such that ejector member 40 does not interfere with the upward movement of the lift arm 10 when in the raised active status.

In an alternative embodiment, the bolt catch assembly as described is combined or incorporated with, or further comprises an insert assembly 50 for the cartridge ejector 51 and magazine stop 52. The exposed portion of the cartridge ejector 51 is a forward facing curved arm extending upward from the lower receiver 30. The magazine stop 52 is a member that extends into the magazine well 41 to abut the magazine 37 when it is inserted into the magazine well 41.

The insert assembly 50 is positioned within a generally rectangular insert recess 53 formed in the upper surface 32 of the lower receiver 30 adjacent the magazine well 41, the configuration of the insert assembly 50 negating the need for lateral pins to secure either the cartridge ejector 51 or the magazine stop 52 to the lower receiver 30. The insert assembly 50 comprises a block body 54 having a recess or notch 55 to receive the base 57 of the cartridge ejector 51, the cartridge ejector 51 being provided with an aperture 58 on its lower portion that is received on a laterally extending post 59. The block body 54 further comprises another recess or notch 55 to receive the magazine stop 52, the magazine stop 52 being provided with a pair of apertures that are received by a pair of laterally extending posts. The block body 53 is provided with a vertical bore 56 through which a bolt is passed into a threaded aperture in the lower receiver insert recess 53 to secure the insert assembly 50 into the lower receiver 30.

It is understood and contemplated that equivalents and substitutions for certain elements set forth above may be obvious to those of ordinary skill in the art, and therefore the true scope and definition of the invention is to be as set forth in the following claims.

The invention claimed is:

1. A firearm bolt catch assembly adapted for use in a firearm having a lower receiver, a magazine follower, a bolt catch and a rifle bolt, said assembly comprising a lift arm, said lift arm comprising a middle segment, a forward leg and a rearward leg, said middle segment connecting said forward leg and said rearward leg, said forward leg having an end adapted to be pivotally mounted onto a lower receiver of a firearm and said rearward leg having an end adapted to be pivotally mounted onto a lower receiver of a firearm, said rearward leg adapted to contact a bolt catch of a firearm;

wherein said end of said forward leg is apertured and adapted to receive a first pin, and said end of said rearward leg is apertured and adapted to receive a second pin, said first and second pins defining a pivot axis for said lift arm;

said lift arm further comprising a follower contact member adapted to pivot said lift arm about said pivot axis when contacted by a magazine follower such that said rearward leg contacts and moves a bolt catch to block forward advancement of a rifle bolt.

2. The assembly of claim 1, wherein said lift arm is C-shaped.

3. The assembly of claim 1, wherein said end of said forward leg and said rearward leg are each joined to said middle segment at a right angle.

4. The assembly of claim 1, wherein said rearward leg is joined to said middle segment by a transition segment such that said rearward leg is lower than said forward leg when pivotally mounted to the lower receiver of the firearm.

5. The assembly of claim 1, wherein said lift aim is C-shaped, wherein said forward leg and said rearward leg are each joined to said middle segment at a right angle, and said rearward leg is joined to said middle segment by a transition segment such that said rearward leg is lower than said forward leg when pivotally mounted to the lower receiver of the firearm.

6. The assembly of claim 5, further comprising an insert assembly comprising a block body, a cartridge ejector and a magazine stop.

7. A firearm bolt catch assembly in combination with a firearm lower receiver having a bolt catch adapted block forward motion a rifle bolt and a magazine well adapted to retain a magazine having a magazine follower, said assembly comprising a lift arm, said lift arm comprising a middle segment, a forward leg and a rearward leg, said middle segment connecting said forward leg and said rearward leg, said forward leg having an end pivotally mounted onto said firearm lower receiver and said rear leg having an end pivotally mounted onto said firearm lower receiver;

wherein said end of said forward leg is apertured and adapted to receive a first pin, and said end of said rearward leg is apertured and adapted to receive a second pin, said first and second pins defining a pivot axis for said lift arm;

wherein said pivot axis is positioned to one side of the bolt catch and said middle segment of said lift arm is positioned to the other side of the bolt catch;

said lift arm further comprising a follower contact member adapted to pivot said lift arm about said pivot axis when contacted by the magazine follower such that said rearward leg contacts and moves the bolt catch to block forward advancement of the rifle bolt.

8. The combination of claim 7, wherein said lift arm is C-shaped.

9. The combination of claim 7, wherein said forward leg and said rearward leg are each joined to said middle segment at a right angle.

10. The combination of claim 7, wherein said rearward leg is joined to said middle segment by a transition segment such that said rearward leg is lower than said forward leg when pivotally mounted to the firearm lower receiver.

11. The combination of claim 7, said firearm lower receiver comprises an upper surface and two transverse recesses disposed in said upper surface, and wherein said forward leg and said rearward leg are positioned at least partially in said transverse recesses.

12. The combination of claim 7, wherein said lift arm is C-shaped, wherein said forward leg and said rearward leg are each joined to said middle segment at a right angle, wherein said rearward leg is joined to said middle segment by a transition segment such that said rearward leg is lower than said forward leg when pivotally mounted to the firearm lower receiver, and said firearm lower receiver comprises an upper surface and two transverse recesses disposed in said upper surface, and wherein said forward leg and said rearward leg are positioned at least partially in said transverse recesses.

13. The combination of claim 12, said firearm lower receiver further comprising an insert recess, said combination further comprising an insert assembly inserted into said insert recess, said insert assembly comprising a block body, a cartridge ejector and a magazine stop.

14. A firearm bolt catch assembly comprising a lift arm, said lift arm comprising a middle segment, a forward leg and a rearward leg, said forward leg having an end adapted to be pivotally mounted onto a lower receiver of a firearm and said rearward leg having an end adapted to be pivotally mounted onto a lower receiver of a firearm;

wherein said lift arm is C-shaped, wherein said end of said forward leg is apertured and adapted to receive a pin, and said end of said rearward leg is apertured and adapted to receive a pin, wherein said forward leg and said rearward leg are each joined to said middle segment at a right angle, said rearward leg is joined to said middle segment by a transition segment such that said rearward leg is lower than said forward leg when pivotally mounted to the lower receiver of the firearm, and said lift arm further comprises a follower contact member, whereby said lift arm is pivotally raised when a magazine follower contacts said follower contact member; and further comprising an insert assembly comprising a block body, a cartridge ejector and a magazine stop.

15. A firearm bolt catch assembly in combination with a firearm lower receiver, said assembly comprising a lift arm, said lift arm comprising a middle segment, a forward leg and a rearward leg, said forward leg having an end pivotally mounted onto said firearm lower receiver and said rear leg having an end pivotally mounted onto said firearm lower receiver;

wherein said lift arm is C-shaped, wherein said end of said forward leg is apertured and adapted to receive a first pin, and said end of said rearward leg is apertured and adapted to receive a second pin, wherein said forward leg and said rearward leg are each joined to said middle segment at a right angle, wherein said rearward leg is joined to said middle segment by a transition segment such that said rearward leg is lower than said forward leg when pivotally mounted to the firearm lower receiver, said lift arm further comprising a follower contact member, whereby said lift arm is pivotally raised when a magazine follower of a magazine inserted into said lower receiver contacts said follower contact member, and said firearm lower receiver comprises an upper surface and two transverse recesses disposed in said upper surface, and wherein said forward leg and said rearward leg are positioned at least partially in said transverse recesses; and said firearm lower receiver further comprising an insert recess, said combination further comprising an insert assembly inserted into said insert recess, said insert assembly comprising a block body, a cartridge ejector and a magazine stop.

16. The assembly of claim 1, wherein said lift arm further comprises a projection member disposed on said rearward leg between said middle segment and said apertured end of said rearward leg, said projecting member adapted to contact a bolt catch.

17. The assembly of claim 16, said projection member having a rounded surface adapted to contact a catch bolt.

18. The assembly of claim 1, wherein said pivot axis is adapted to be located on a firearm lower receiver such that said pivot axis is on one side of a bolt catch and said middle segment is on the other side of a bolt catch.

19. The assembly of claim 7, wherein said lift arm further comprises a projection member disposed on said rearward leg between said middle segment and said apertured end of said rearward leg, said projecting member adapted to contact the bolt catch.

20. The assembly of claim 19, said projection member having a rounded surface contacting the catch bolt.

* * * * *